US008205868B2

(12) United States Patent
Kubota

(10) Patent No.: US 8,205,868 B2
(45) Date of Patent: Jun. 26, 2012

(54) INSPECTION APPARATUS, METHOD OF CONTROLLING THE SAME, AND STORAGE MEDIUM

(75) Inventor: Tsutomu Kubota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 65 days.

(21) Appl. No.: 12/914,748

(22) Filed: Oct. 28, 2010

(65) Prior Publication Data

US 2011/0129239 A1 Jun. 2, 2011

(30) Foreign Application Priority Data

Dec. 2, 2009 (JP) ..... 2009-274184

(51) Int. Cl.
*B65H 33/04* (2006.01)

(52) U.S. Cl. ..... 270/58.32; 270/58.31; 270/58.04; 700/222; 700/223

(58) Field of Classification Search ..... 270/52.04, 270/58.04, 58.31, 58.32; 700/222, 223
See application file for complete search history.

(56) References Cited

U.S. PATENT DOCUMENTS

2005/0158093 A1* 7/2005 Kato et al. ..... 399/388
2008/0107433 A1* 5/2008 Yamamoto et al. ..... 399/45
2008/0131182 A1* 6/2008 Okajima ..... 400/76

FOREIGN PATENT DOCUMENTS

JP 2001013823 A * 1/2001
JP 2006-091212 A 4/2006
JP 2006273459 A * 10/2006

* cited by examiner

*Primary Examiner* — Leslie A Nicholson, III
(74) *Attorney, Agent, or Firm* — Canon USA, Inc., IP Division

(57) ABSTRACT

Tab positions of tab sheets that are inserted between printed pages while a print job is performed are determined to be correct or incorrect using a control method for controlling an inspection apparatus which is connectable to a printing apparatus. The method includes reading tab sheets conveyed from the printing apparatus, detecting positions of tabs of the tab sheets conveyed from the printing apparatus according to the reading result, and determining whether each of the detected positions is correct or incorrect.

7 Claims, 7 Drawing Sheets

INSPECTION APPARATUS, METHOD OF CONTROLLING THE SAME, AND STORAGE MEDIUM

BACKGROUND OF THE INVENTION

1. Field of the Invention

The present invention relates to an inspection apparatus, a method of controlling the same, and a recording medium.

2. Description of the Related Art

There exists printing apparatuses (inspection apparatuses) that inspect printed products. Such apparatuses are capable of determining whether printed images are correct. Japanese Patent Application Laid-Open No. 2006-091212 discusses a printing apparatus that checks a direction of a sheet by finding a hole in the sheet after print and determining the location of the hole in the sheet.

There also conventionally exists printing apparatuses that perform a print job that is set to insert tab sheets having projecting portion. The set of tab sheets consist of plural sheets having projecting portions at different location in sheets from one another.

However, by the conventional technique printing apparatuses cannot inspect whether tab sheets are inserted in the correct order between printed sheets while a print job is performed. For example, assume that five tab sheets 1 to 5 are inserted between printed pages while a print job is performed, the tab sheets having projecting portions at different location in sheets. The tab sheets set in a sheet feeding unit in the correct order will be inserted in the correct order when a print job is done, resulting in successive insertion of the sheets between printed pages with the tabs being arranged in sequence.

However, the tab sheets set in a sheet feeding unit in the incorrect order when the printing job is performed, results in the insertion of the tab sheets between printed pages in the incorrect order. As described above in the conventional technique, printing apparatus cannot determine the incorrect insertion of the tab sheets.

SUMMARY OF THE INVENTION

The present invention provides an inspection apparatus which is connectable to a printing apparatus, including, a reading unit configured to read a tab sheet conveyed from a printing apparatus, a detecting unit configured to detect the position of a tab of the tab sheet conveyed from the printing apparatus based on the result read by the reading unit, and a determining unit configured to determine whether the tab position detected by the detecting unit is correct or incorrect.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
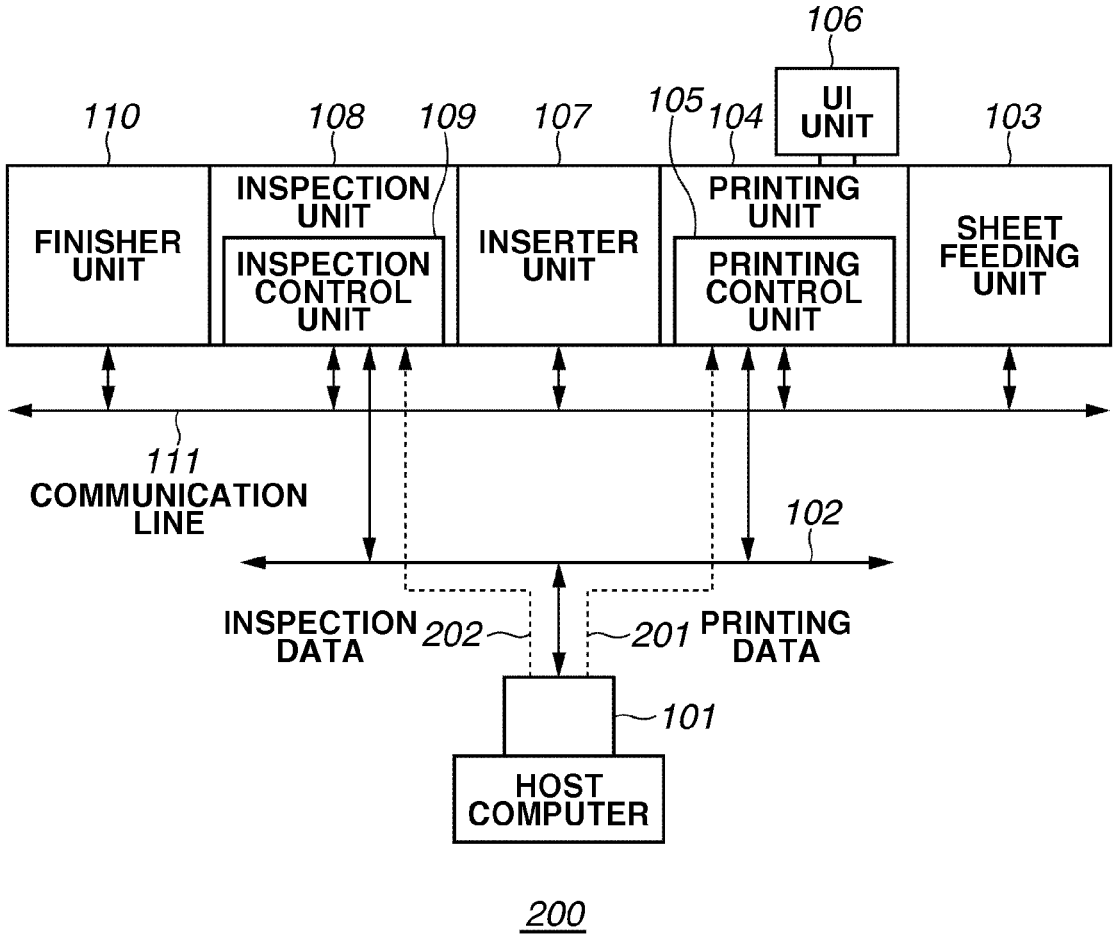
FIG. 1 is a block diagram illustrating a configuration of a printing apparatus.

FIG. 1 is a block diagram illustrating a configuration of a printing apparatus of the present exemplary embodiment. A printing apparatus 200 is generally controlled by a print control unit 105. The printing control unit 105 communicates with an inspection unit 108 and a finisher unit 110 to control interruption and restart of job processing for example.

In FIG. 1, a host computer (information processing apparatus) 101 outputs print data 201 and inspection data 202 to the printing apparatus 200. The inspection data includes outline shape information that is used to determine whether the tab positions of the tab sheets inserted from an inserter unit are in the correct order.

A network 102 connects the host computer 101 to a printing control unit 105 and an inspection control unit 109 in the printing apparatus 200. A printing unit 104 performs printing of data onto printing paper fed from a sheet feeding unit 103.

The printing control unit 105 generates image data based on print data received from the host computer 101, and controls the printing unit 104. A user interface (UI) unit 106 displays information stored in the printing apparatus 200, and allows users to input print settings therethrough.

Figure 4A:
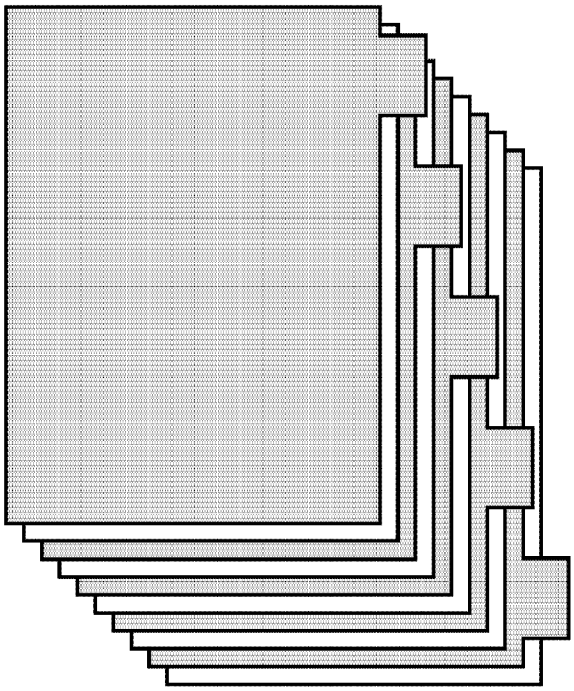
FIGS. 4A and 4B illustrate states of tab sheets inserted between printed paper.
Figure 4B:
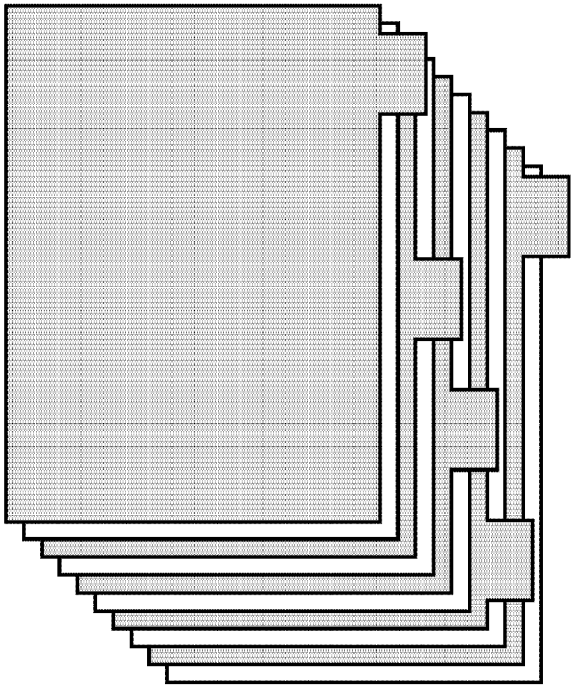

An inserter unit 107 inserts tab sheets (which are also referred to as index sheets) between pages printed by the printing unit 104. Specifically, the inserter unit 107 inserts successively a tab sheet from one set of tab sheets between printed sheets that are conveyed in the printing apparatus 200, in response to an instruction from the printing control unit 105. FIG. 4A illustrates an insertion order in which positions of the tabs are inserted correctly, while FIG. 4B illustrates an incorrect (wrong) order (an error of insertion order).

An inspection unit 108 includes two sensors to inspect the image information both on paper printed by the printing unit 104 and on the tab sheets inserted from the inserter unit 107. The disposition of the sensors and reading processes will be described below with reference to FIG. 2.

An inspection control unit 109 controls the operation of inspection unit 108 so as to compare the papers printed by the printing control unit 105 and the tab sheets with inspection data generated from a job received from the host computer 101 and judge the quality. The inspection unit 108 is provided with a plurality of path switching units for switching a destination of the printed paper or tab sheets to a buffer tray (retreating area), the destination being determined by an instruction from the inspection control unit 109.

A finishing unit 110 performs post-processing such as stapling and gluing on the printed paper. A communication line 111 connects the units in the printing apparatus 200 to one another for communication.

In FIG. 1, the dotted line 201 illustrates the flow of print data from the host computer 101 to the printing control unit 105, while the dotted line 202 illustrates the flow of inspection data from the host computer 101 to the inspection control unit 109.

Figure 2:
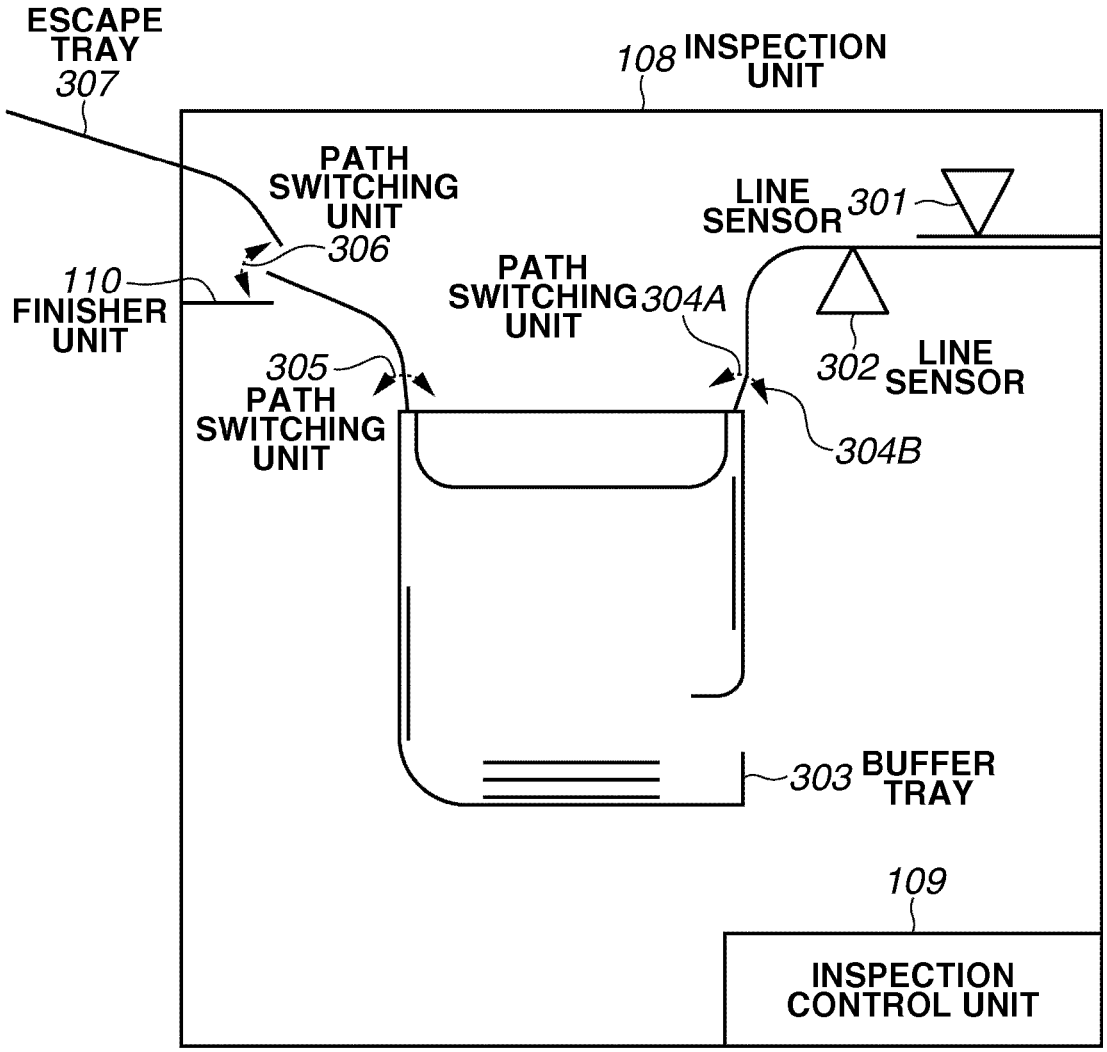
FIG. 2 illustrates conveyance paths of sheets in an inspection unit.

FIG. 2 illustrates an example of conveyance paths for paper fed in the inspection unit 108.

In FIG. 2, a line sensor 301 is a reading device that reads images of one surface (front surface) of printed paper. A line sensor 302 reads images of the other surface (rear surface) which is reverse to line sensor 301. A buffer tray 303 is where any paper remaining in the apparatus is retreated when printed paper is determined to be NG through an inspection. The NG for printed paper is determined in the cases, for example, where the tab positions of inserted tab sheets are different from those in the predetermined correct order and thereby the tab sheets are inserted in the incorrect (wrong) order.

Path switching units 304, 305, and 306 are switched according to instructions from the inspection control unit 109 that serves as a discharge control device. Specifically, the inspection control unit 109 switches a destination of printed paper to an escape tray so that reprinted paper (paper being conveyed in the apparatus) is fed to the finisher unit 110 while maintaining the correct order of pages in a job. An escape tray 307 is where the paper determined to be NG by the inspection unit 108 after printing is discharged to be retreated.

The path switching unit 304 switches destinations between 304A and 304B: the destination 304B leads image-printed paper or tab sheets to the buffer tray 303 as a retreating area, when the image-printed papers or the tab sheets are determined to be fed in the wrong order.

The outline shape information of tab sheets generated by the inspection control unit 109 may be stored in the printing apparatus 200 in advance, so that only printing data and information about insertion position of the tab sheets are transmitted from the host computer 101 to the printing apparatus 200. In this case, the printing apparatus 200 generates image data illustrated in FIG. 3 based on the printed data and the information about insertion position, to compare the generated image data with the image data read by the inspection unit 108.

Figure 3:
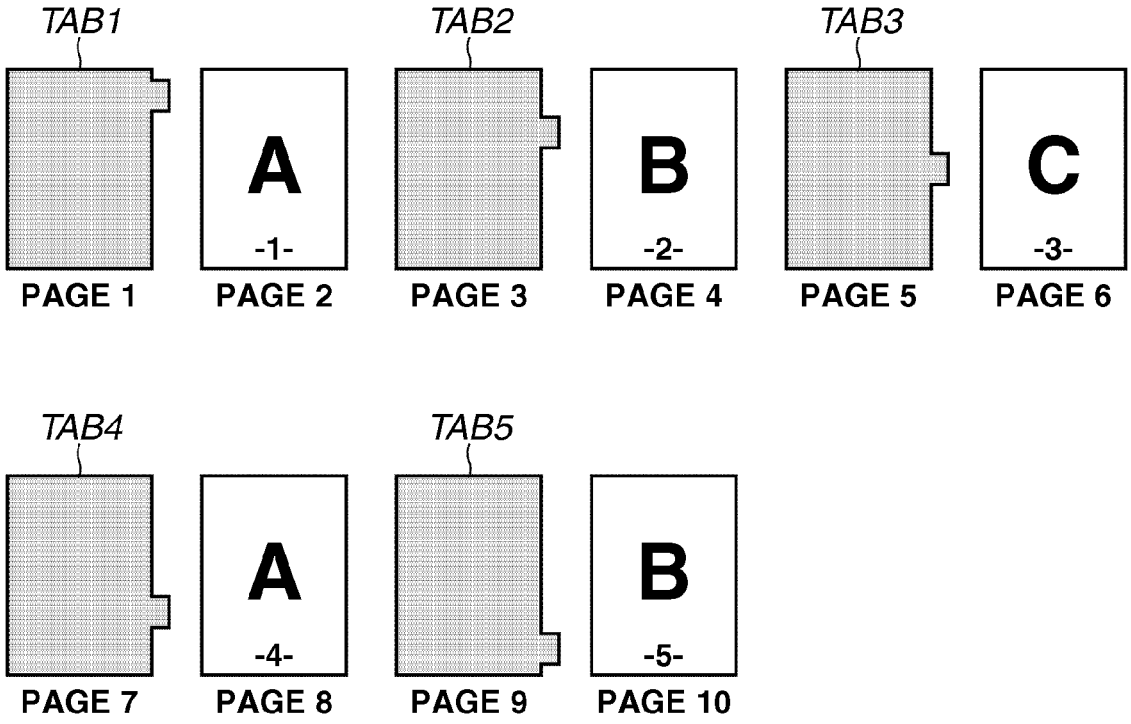
FIG. 3 illustrates a job configuration processed by the printing apparatus in FIG. 1.

FIG. 3 illustrates a job configuration processed by the printing apparatus 200 in FIG. 1.

The present exemplary embodiment illustrates a job generated by an application program in the host computer 101 to insert tab sheets among printing data.

In FIG. 3, the even-numbered pages represent a print job, and the odd-numbered pages represent one set of tab sheets TAB 1 to 5 that are inserted from the inserter unit 107.

A user generates the job using an application program installed in the host computer 101. The application creates printing data and inspection data as one job, and transmits them to the printing apparatus 200.

In the printing apparatus 200, the tab sheets TAB 1 to 5 are set in the inserter unit 107 by a user before printing. Then, printing of the job is started.

FIGS. 4A and 4B illustrate states of tab sheets inserted between printed papers according to the job in FIG. 3. FIG. 4A illustrates a case where the job is normally processed: FIG. 4B illustrates a case where the job is not normally processed and the tab sheets are inserted in the wrong order. Now, operations for printing and inspection are described.

Figure 5:
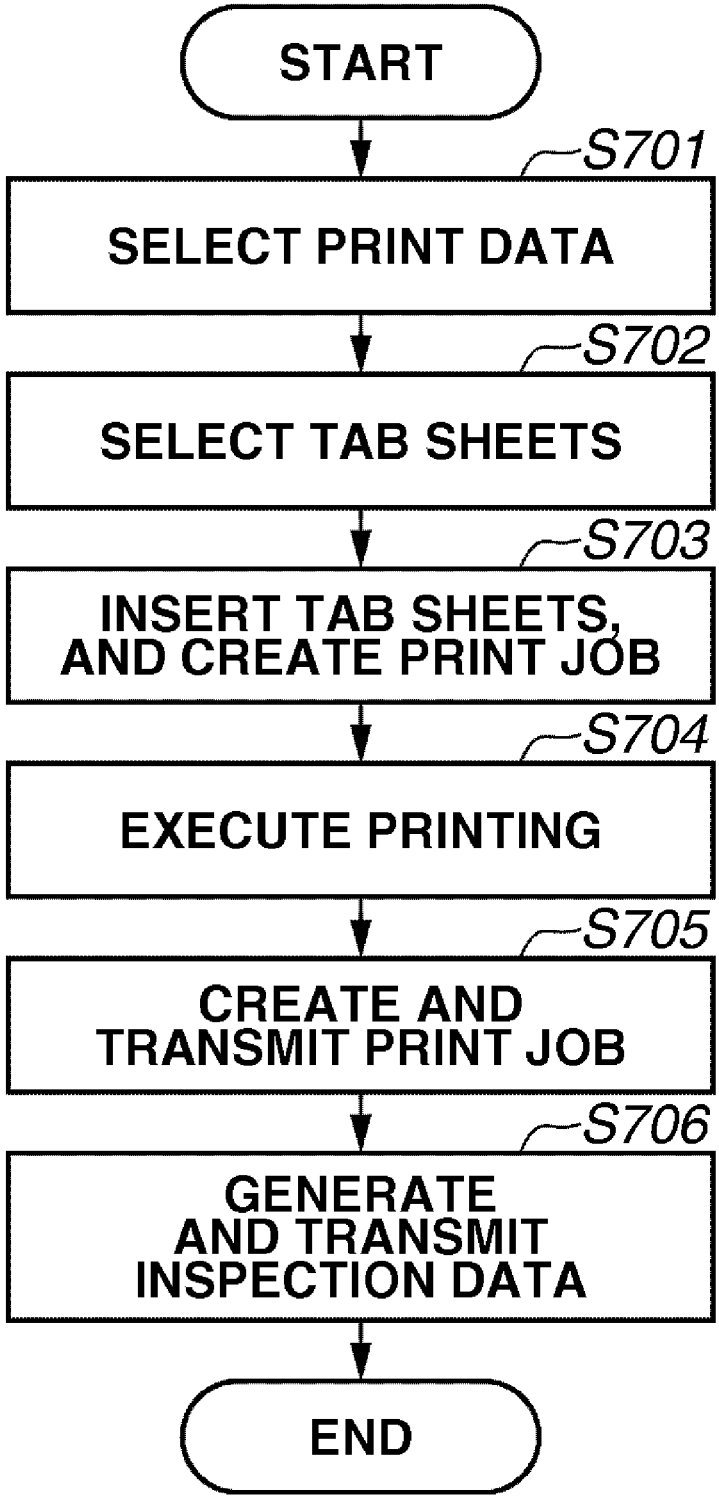
FIG. 5 is a flowchart illustrating data processing procedure performed by an information processing apparatus.

FIG. 5 is a flowchart illustrating an example of data processing procedure performed by an information processing apparatus according to the present exemplary embodiment. This example is achieved when a central processing unit (CPU) of the host computer 101 loads control programs stored in a hard disk or a read only memory (ROM) into a random access memory (RAM) and executes them. The host computer 101 stores system programs such as operation system (OS) and application programs therein, and includes a network interface controller (NIC) that allows communication with the printing apparatus 200 through a network 102.

A user creates document data of the print data having the tab sheets inserted therebetween, using an application program in the host computer 101. In step S701, the CPU in the host computer 101 receives a selection of print data to be printed, and in step S702 receives a selection of tab sheets to be inserted from a user. At the step S701 and step S702, the CPU in the host computer 101 receives these selections through a user interface (UI) screen provided by an application. The following is specific description of the example illustrated in FIG. 3 in which tab sheets are inserted between printing data.

At the step S703, the application determines the order to insert the tab sheets selected by the user among the printing data, and creates the job illustrated in FIG. 3. FIG. 3 illustrates an example where each tab sheet is inserted between every one printing data.

At the step S704, the CPU in the host computer 101 receives an instruction to print the job in FIG. 3 through the UI screen from the user. In response to the instruction, the CPU in the host computer 101 creates a job (including the printing data 201 and the inspection data 202) to be transmitted to the printing apparatus 200 based on the generated document data.

At the step S705, the CPU in the host computer 101 transmits the job to the printing control unit 105 in the printing apparatus 200, and at the step S706, transmits the inspection data 202 to the inspection control unit 109. The inspection data 202 contains the outline shape information of the tab sheets used. The outline shape information indicates outer profile of the TABs 1 to 5 in FIG. 3. Alternatively, the shape information may be other image data indicating the shapes of the TABs 1 to 5.

Figure 6:
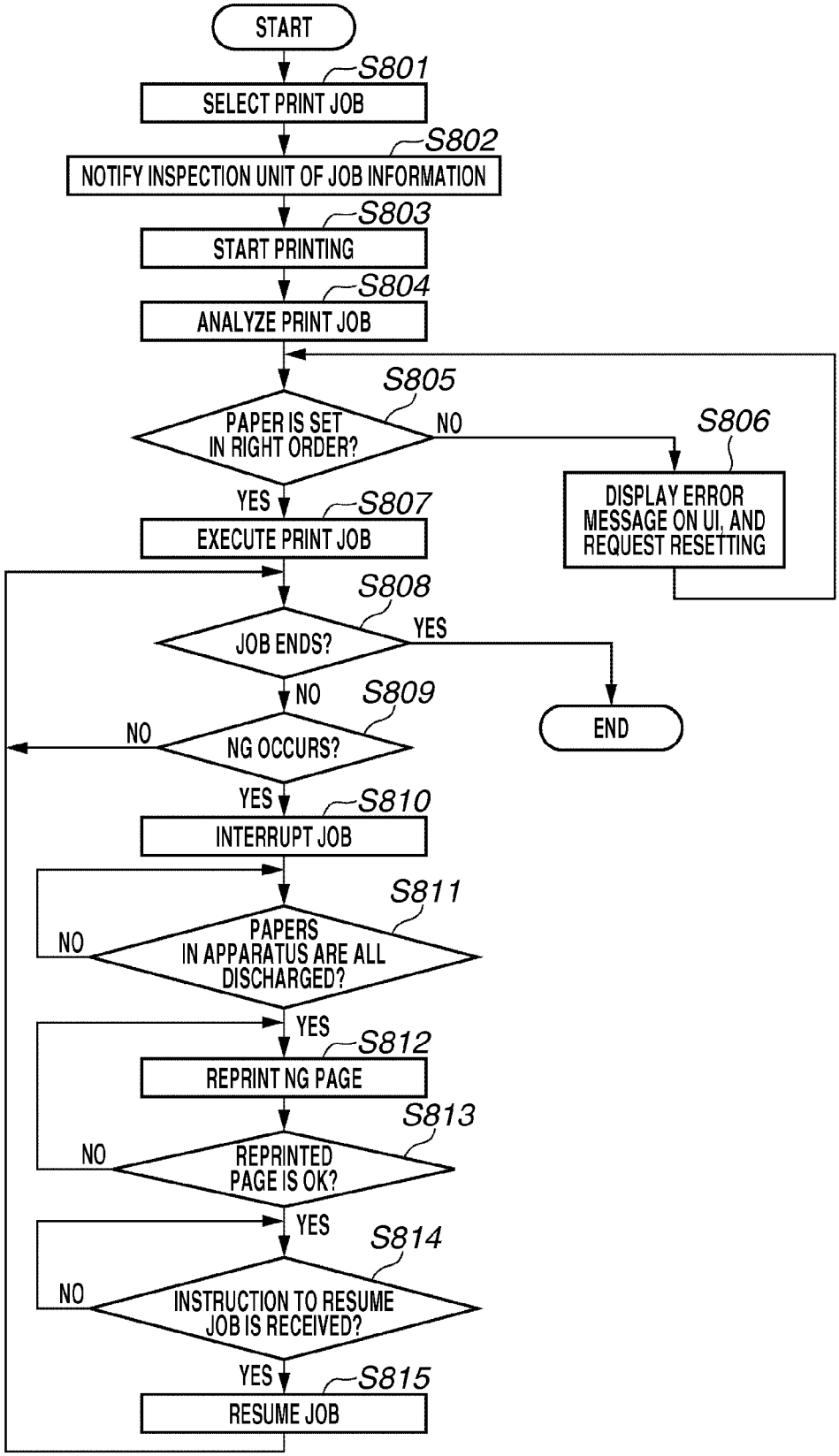
FIG. 6 is a flowchart illustrating control procedure performed by a printing apparatus.

FIG. 6 is a flowchart of an example of control procedure performed by a printing apparatus according to the present exemplary embodiment, illustrating a procedure to perform a job that is received by the printing apparatus 200 from the host computer 101. Each step in the procedure is achieved when the printing control unit 105 loads a control program stored in a memory (not illustrated) into a RAM for example and executes it.

A user confirms the receipt of jobs from the host computer 101, through operations of the UI unit 106. Note that the jobs received in the printing apparatus 200 are stored in a hard disk drive (HDD) (not illustrated) in the printing apparatus 200. The user selects a print job among the received jobs, and sets printing paper in the sheet feeding unit 103, and inserting paper in the inserter unit 107, based on job information. The inserting paper in the inserter unit 107 consists of one set of five sheets with tabs. In setting, the user sets a plural tab sheets in a sheet feeding unit of the inserter unit 107 and the location of tabs in sheets are different from one another. The user, however, may set the tab sheets at the wrong location of tab in sheet or in the wrong order as described above (see FIG. 4B).

In step S801, the user selects the print job through the UI unit 106, and then in step S802, the printing control unit 105 notifies the inspection control unit 109 of job information to be executed next.

In step S803, the user instructs a start of printing through the UI unit 106, and the printing control unit 105 starts printing procedure of the print job received from the host computer 101. In step S804, the printing control unit 105 analyzes the printing job, and in step S805, based on the analyzed result, confirms the settings of paper in the designated sheet feeding unit 103 and the inserter unit 107 with reference to the output from sensors (not illustrated). Based on the result of analyzing the printing job, the printing control unit 105 also specifies the paper size for the print job, and the information of pages where the tab sheets are inserted.

In step S806, when determining that the paper is not set, or that the paper size is wrong, the printing control unit 105 controls the UI unit 106 to display an error message, to request the user for setting of paper or tab sheets.

In step S805, when the printing control unit 105 determines that paper is correctly set in the sheet feeding unit 103 and the inserter unit 107 (YES in step S805), the procedure goes to step S807.

In step S807, the printing control unit 105 generates image (image data) to be printed on the paper from the print job. The printing control unit 105 also feeds the tab sheets from the inserter unit 107, according to the print job. Furthermore, the printing control unit 105 prints the image data on the paper fed from the sheet feeding unit 103, and conveys the paper to the inspection unit 108. In this way, the printing control unit 105 performs a print job.

The paper printed by the printing unit 104 and the sheet inserted from the inserter unit 107 are sequentially conveyed to the inspection unit 108. The tab sheets set in the inserter unit 107 in the correct order are assumed to be conveyed in the order of a job created by an application program in the host computer 101 as illustrated in FIG. 4A.

In step S808, the printing control unit 105 determines whether the overall printing is normally finished (job ends). When determining that the job is not finished yet, in step S809, the printing control unit 105 determines whether the tab sheets inserted from the inserter unit 107 are reported to be NG through inspection, based on notification from the inspection control unit 109.

When the printing control unit 105 determines that the tab sheets are reported to be NG through inspection (YES in step S809), the procedure goes to step S810, where the printing control unit 105 interrupts the print procedure of the selected job.

In step S811, the printing control unit 105 starts discharge of the paper remaining in the apparatus to the outside, and confirms no remaining paper in the apparatus (YES in step S811): the procedure goes to step S812.

In step S812, the printing control unit 105 reprints the pages that are reported to be NG, in response to the received job, and in step S813, confirms that the reprinted page is reported to be OK through inspection in the inspection control unit 109 (YES in step S813). Then, the procedure goes to step S814, where the printing control unit 105 receives an instruction to resume the print job from the UI unit 106 (YES in step S814). In step S815, the printing control unit 105 resumes the interrupted job processing from the page that is not printed yet. Then, the procedure goes back to step S808.

In contrast, in step S808, when the printing control unit 105 determines the overall printing is normally done (YES in step S808), the job ends here.

Figure 7:
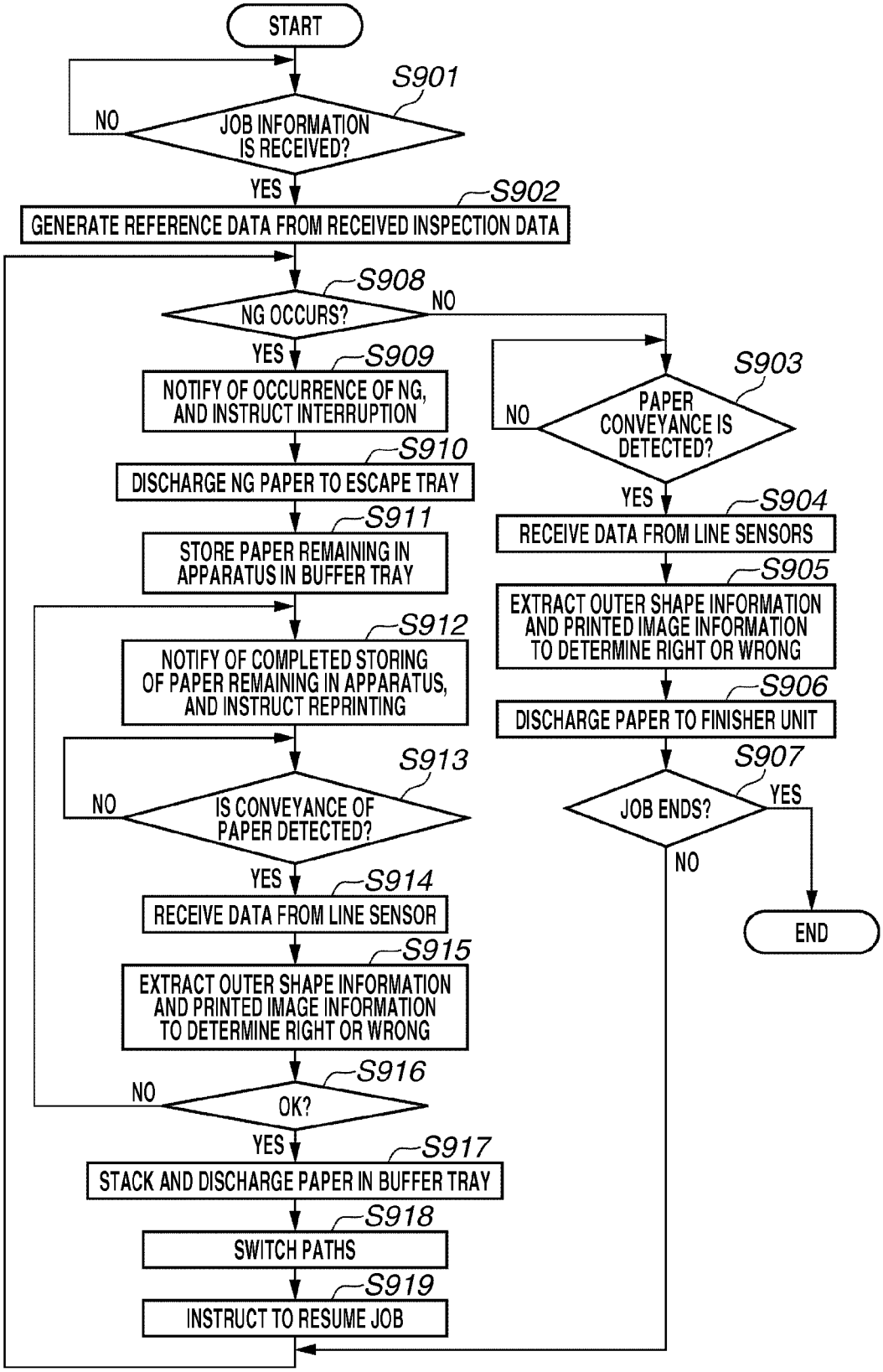
FIG. 7 is a flowchart illustrating control procedure performed by an inspection control unit in a printing apparatus.

FIG. 7 is a flowchart illustrating an example of control procedure performed by a printing apparatus according to the present exemplary embodiment. This example is performed by the inspection control unit 109 in the printing apparatus 200.

The inspection control unit 109 loads a control program stored in a memory (not illustrated) into RAM for example and executes it so that each step in the procedure is achieved.

In step S901, the inspection control unit 109 receives information about a job to perform, from the printing control unit 105. After the receipt of the information (YES in step S901), the inspection control unit 109 specifies the inspection data 202 corresponding to the job, from the inspection data 202 received from the host computer 101 and stored in the HDD (not illustrated) in the inspection control unit 109. The HDD may be provided in the printing control unit 105, so that the inspection control unit 109 reads the inspection data 202 from the HDD in the printing control unit 105. In step S902, the inspection control unit 109 generates reference data using the specified inspection data 202. The reference data generated by the inspection control unit 109 contains printed page information of the images to be printed, and the outline shape information of the tab sheets.

For example, when the job is performed in the order illustrated in FIG. 3, the printing control unit 105 generates the pages 2, 4, 6, 8, and 10 in FIG. 3 as printed page information: and generates the pages 1, 3, 5, 7, and 9 as outline shape information.

In step S903, the inspection unit 108 detects the conveyance of the paper with reference to the output of a sensor (not illustrated), and reads the printed image on the conveyed paper using the line sensors 301 and 302. In step S904, the inspection control unit 109 receives the read image data. The inspection control unit 109 includes a memory for storing the read image data.

In step S905, the inspection control unit 109 receives the image data from the line sensors 301 and 302, extracts the outline shape information and the printed page information of the paper, and compares both of the information with the reference data generated in step S902, to check the error of the paper and the sheets. When inspection control unit 109 determines that the outline shape information and the printed image information of the paper is arranged in the same correct (right) order as that indicated in the reference data, and that there is no problem with the tab sheets including the outline shapes, in step S906, the inspection control unit 109 discharges the conveyed paper (including the printed papers and the tab sheets) to the finisher unit 110, and repeats the operations from step S903 to step S907 until the job ends in step S907.

Because the inserted tab sheets have no data printed thereon, the image data read from the tab sheets by the line sensors 301 and 302 is checked for stain, and only the outline shape information is extracted and compared with the reference data.

The outline shape information may be extracted from the image data obtained by the line sensor 302. The paper is illuminated with light from the bottom side of the paper, therefore the light is not reflected outside the paper so that the line sensor 302 can generate the outline shape information.

The pages and paper surfaces printed with printing data are compared with the corresponding reference data, and those without printing data are checked for stain.

In step S908, when the inspection control unit 109 finds some problem through inspection (YES in step S908), the procedure goes to step S909. In step S909, the inspection control unit 109 notifies the printing control unit 105 of occurrence of NG, and instructs interruption of the printing. In step S910, the destination of the path switching unit 306 is switched to the escape tray 307, so that the paper determined to be NG is discharged to the escape tray 307.

In step S911, the inspection control unit 109 switches the path switching unit 304 to the destination 304B toward the buffer tray 303, and inspects the paper that are conveyed inside the apparatus, and stores the paper in the buffer tray 303.

After every paper remaining in the apparatus is stored in the buffer tray 303, in step S912, the inspection control unit

109 notifies the printing control unit 105 that the storing is completed, and issues a reprinting instruction to recovery-print the pages that are determined to be in the wrong order.

In step S913, the inspection unit 108 detects the conveyance of the paper which has undergone recovery printing made by the printing control unit 105 (YES in step S913). In step S914, the line sensors 301 and 302 read the images printed on the paper. In step S915, the inspection control unit 109 extracts outline shape information and printed image information of the paper, and compares both of the information with the reference data generated in step S902, to inspect the error of the paper and the tab sheets.

In step S916, the inspection control unit 109 determines whether the inspection result is OK or not. When the inspection control unit 109 determines the inspection result is OK (YES in step S916), in step S917, the pages having recovery printing are stacked in the buffer tray 303, and the destination of the path switching units 305 and 306 is switched so that the paper is conveyed from the buffer tray 303 to the finisher unit 110. The inspection control unit 109 starts to discharge the paper from the buffer tray 303 to the finisher unit 110. During the discharge, a paper feed roller (not illustrated) feeds the paper in the buffer tray 303 from under sequentially, such that the paper discharged into the finisher unit 110 are stacked in the correct (right) order.

In step S918, the inspection control unit 109 switches the path switching unit 304 to the destination 304A, and in step S919, issues an instruction to the printing control unit 105 to resume the job: the procedure goes back to step S908.

In step S907, the inspection control unit 109 completes inspections of all of the conveyed paper, and determines whether to end the job. When the inspection control unit 109 determines to end the job (YES in step S907), the procedure ends here, otherwise goes back to step S908 to repeat the above operations.

If paper is jammed in a paper conveyance path in the printing unit 104, the inserter unit 107, the inspection unit 108, and the finisher unit 110, a user removes the paper from the apparatus as a recovery operation, and issues an instruction to resume the job.

In the cases where at least one set of multiple tab sheets is used as in the above exemplary embodiment, the tab sheets need to be reset in the inserter unit 107 such that the tab sheet corresponding to the page that is reprinted first is inserted first when the job is resumed. For this resetting, the printing control unit 105 may cause a user to reset the corresponding tab sheet in the inserter unit 107, using a message displayed on the UI unit 106.

If the resetting is not carried out, the tab sheets are output in the wrong order as illustrated in FIG. 6. If printing is made on the tabs of tab sheets, the print data needs to be inspected by comparison, but when the tab sheets are simply inserted without printing thereon, only their outline shapes (outer profiles) are inspected, accordingly the workload in the process in the latter case becomes smaller than the case where the entire image areas of tab sheets are compared for inspection.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium). In such a case, the system or apparatus, and the recording medium where the program is stored, are included as being within the scope of the present invention While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-274184 filed Dec. 2, 2009, which is hereby incorporated by reference herein in its entirety.

What is claimed is:

1. An inspection apparatus which is connectable to a printing apparatus, the inspection apparatus comprising:

a reading unit configured to read tab sheets conveyed from the printing apparatus;

a detecting unit configured to detect positions of tabs of the tab sheets conveyed from the printing apparatus, according to the reading result obtained by the reading unit; and a determining unit configured to determine whether each of the positions of tabs detected by the detecting unit is correct or incorrect.

2. The inspection apparatus according to claim 1, further comprising, an output control unit configured to discharge a tab sheet having a tab determined to be in the incorrect position by the determining unit to a destination different from a destination of a tab sheet having a tab determined to be in the correct position.

3. The inspection apparatus according to claim 2, further comprising, a reprinting unit configured to reprint the tab sheet having the tab determined to be in the correct position by the output control unit.

4. The inspection apparatus according to claim 1, wherein the determining unit determines whether the positions of the tabs of the tab sheets conveyed from the printing apparatus are correct or incorrect, based on outer profiles of the tab sheets, the outer profiles being contained as information in the reading result obtained by the reading unit.

5. The inspection apparatus according to claim 1, wherein the determining unit determines whether the positions of the tabs of the tab sheets conveyed from the printing apparatus are correct or incorrect, by comparing the reading result obtained by the reading unit with reference data received from an external apparatus connected to the inspection apparatus.

6. A control method for controlling an inspection apparatus which is connectable to printing apparatus, comprising:

reading tab sheets conveyed from the printing apparatus;

detecting positions of tabs of the tab sheets conveyed from the printing apparatus according to the reading result; and determining whether each of the detected positions is correct or incorrect.

7. A computer readable storage medium for storing computer-executable instructions for controlling an inspection apparatus which is connectable to printing apparatus, comprising:

instructions for reading tab sheets conveyed from the printing apparatus;

instructions to detect positions of tabs of the tab sheets conveyed from the printing apparatus according to a result of the reading; and instructions to determine whether each of the detected positions is correct or incorrect.

* * * * *